US008057243B2

(12) United States Patent
Lee et al.

(10) Patent No.: US 8,057,243 B2
(45) **Date of Patent: *Nov. 15, 2011**

(54) IN-WALL MOUNTED RECEPTACLE DEVICE

(75) Inventors: Yu-Lung Lee, Miaoli County (TW); Ming-Chou Kuo, Taipei (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

This patent is subject to a terminal disclaimer.

(21) Appl. No.: 12/911,894

(22) Filed: Oct. 26, 2010

(65) Prior Publication Data

US 2011/0237119 A1 Sep. 29, 2011

Related U.S. Application Data

(62) Division of application No. 12/783,876, filed on May 20, 2010.

(30) Foreign Application Priority Data

Mar. 24, 2010 (TW) ..... 99108670 A

(51) Int. Cl.
*H01R 13/14* (2006.01)

(52) U.S. Cl. ..... 439/131

(58) Field of Classification Search ..... 439/131, 439/31, 165; 174/57, 59
See application file for complete search history.

(56) References Cited

U.S. PATENT DOCUMENTS 2,751,488 A * 6/1956 Morrison ..... 362/89
5,023,396 A * 6/1991 Bartee et al. ..... 174/486
6,028,267 A * 2/2000 Byrne ..... 174/59

* cited by examiner

*Primary Examiner* — Phuong K Dinh
(74) *Attorney, Agent, or Firm* — Rosenberg, Klein & Lee

(57) ABSTRACT

An in-wall mounted receptacle device includes a body and an electrical outlet box, wherein the body has an accommodating section. The electrical outlet box has a junction surface and is disposed inside the body. When the electrical outlet box rotates, a perpendicular direction of the junction surface varies and points outwardly or inwardly. Whereby, the in-wall mounted receptacle device of the present invention is capable of receiving both an electrical plug which is connected with the junction surface and an electric wire coupled to the electrical plug into the accommodating section, thereby preventing the electrical plug from exposure outside and further reducing the occupied space of the electrical plug. Moreover, the orientation of the junction surface is capable of changing directions so as to alter the direction of the electric wire adjacent to the electrical plug, thereby minimizing the possibility of bending or damaging the electric wire exposed outside.

6 Claims, 4 Drawing Sheets

IN-WALL MOUNTED RECEPTACLE DEVICE

RELATED APPLICATIONS

This application is a Divisional patent application of co-pending application Ser. No. 12/783,876, filed on 20 May 2010. The entire disclosure of the prior application, Ser. No. 12/783,876, from which an oath or declaration is supplied, is considered a part of the disclosure of the accompanying Divisional application and is hereby incorporated by reference.

BACKGROUND OF THE INVENTION

1. Field of the Invention

The invention relates to a receptacle device, in particular, to an in-wall mounted receptacle device which is utilized to accommodate an electrical plug.

2. Description of Related Art

With the present continuous development of modern society, more and more electronic devices are utilized in public.

To pursue more convenience and comfortable living quality, the volumes of electronic devices are designed to be thinner and slimmer so as to minimize occupied spaces for the electronic devices and increase the space utilization efficiency.

As shown in FIG. 1, the electronic device 10 usually connects to a wall electrical power outlet 14 through an electrical plug 121 and an electric wire 123, so as to provide the electrical power to the electronic device 10. The outer structure of the electronic device 10 is usually designed as a wall-mounted style or a wall embedded style. When users use the electronic device 10, the electrical plug 121 of the electronic device 10 is concealed behind the electronic device 10. This serves to ensure that the environment looks neat.

However, the electrical plug 121 which is concealed behind the electronic device 10 occupied a certain space may cause the electronic device 10 to keep a distance away from a wall, thereby affecting reduction of the space. Moreover, the electronic device 10 adjacent to the wall may easily be pushed and pressed toward the electrical plug 121 connected to the conventional wall electrical power outlet 14. The electric wire 123 adjacent to the electrical plug 121 may be pushed or pressed easily and eventually damage the electric wire 123, such that the electrical wire 123 is in an open loop and the application safety of the electronic device 10 may be affected.

SUMMARY OF THE INVENTION

The above deficiencies and problems associated with the conventional wall electrical power outlet are primarily the occupied spaces when the electrical plugs of the electronic devices are in use. As per the aforementioned issues, the objective of the present invention is to provide an in-wall mounted receptacle device which has a space for accommodating the electrical plug and receiving the electric wire connected to the electrical plug, so that the overall environment maintains in a tidy appearance, thereby reducing the damages caused by bending, pushing, or pulling the electric wire.

To achieve the aforementioned objectives, a technical proposal of the present invention is to provide an in-wall mounted receptacle device, which has a body and an electrical outlet box, wherein the body has an accommodating section. The electrical outlet box has a junction surface and is disposed inside the body. When the electrical outlet box rotates, a perpendicular direction of the junction surface varies and points outwardly or inwardly. Whereby, the in-wall mounted receptacle device of the present invention is capable of receiving both an electrical plug which is connected with the junction surface and an electric wire coupled to the electrical plug into the accommodating section, thereby preventing the electrical plug from exposure outside and further reducing the occupied space of the electrical plug. Moreover, the orientation of the junction surface is capable of changing directions so as to alter the direction of the electric wire adjacent to the electrical plug, thereby minimizing the possibility of bending or damaging the electric wire exposed outside.

Therefore, the in-wall mounted receptacle device in accordance with certain aspects of the present invention has a simplified structural design and is operated conveniently to control the electrical outlet box in different orientations with respect to positions of the electronic devices distributed by the user. When the user is utilizing the in-wall mounted receptacle device, the electrical outlet box is firstly rotated outward (an exposed state) to the user to plug the electrical plug into the electrical outlet box. Then, the electrical outlet box is rotated inward (a concealed state) to the body, such that the electrical plug is capable of locating inside the accommodating section, thereby maintaining the outer appearance of the in-wall mounted receptacle device in a tidy state. When the user wants to pull out the electrical plug, the electrical outlet box is rotated from the concealed state to the exposed state and the electrical plug is released.

To achieve the aforementioned objectives, another technical proposal of the present invention is to provide an operating method. The operating method includes installing an electrical outlet box in an accommodating section and an operating direction of a junction surface on the electrical outlet box varies as long as the electrical outlet box rotates; connecting an electrical plug to the junction surface; and rotating the junction surface so as to allow the electrical plug be received inside the accommodating section and eventually retaining an electric wire of the electrical plug in a notch.

In order to further understand the techniques, means and effects the present invention takes for achieving the prescribed objectives, the following detailed description and included drawings are hereby referred, such that, through which, the purposes, features and aspects of the present invention can be thoroughly and concretely appreciated; however, the included drawings are provided solely for reference and illustration, without any intention to be used for limiting the present invention, whose full scope and dimension is described only in the later following claims.

DETAILED DESCRIPTION OF THE PREFERRED EMBODIMENTS

The present invention is an in-wall mounted receptacle device, utilizes a simplified structural design to accommodate electrical plugs and protect electric wires connected to the electrical plugs, such that an overall appearance beautification of the in-wall mounted receptacle device is achieved.

Figure 1:
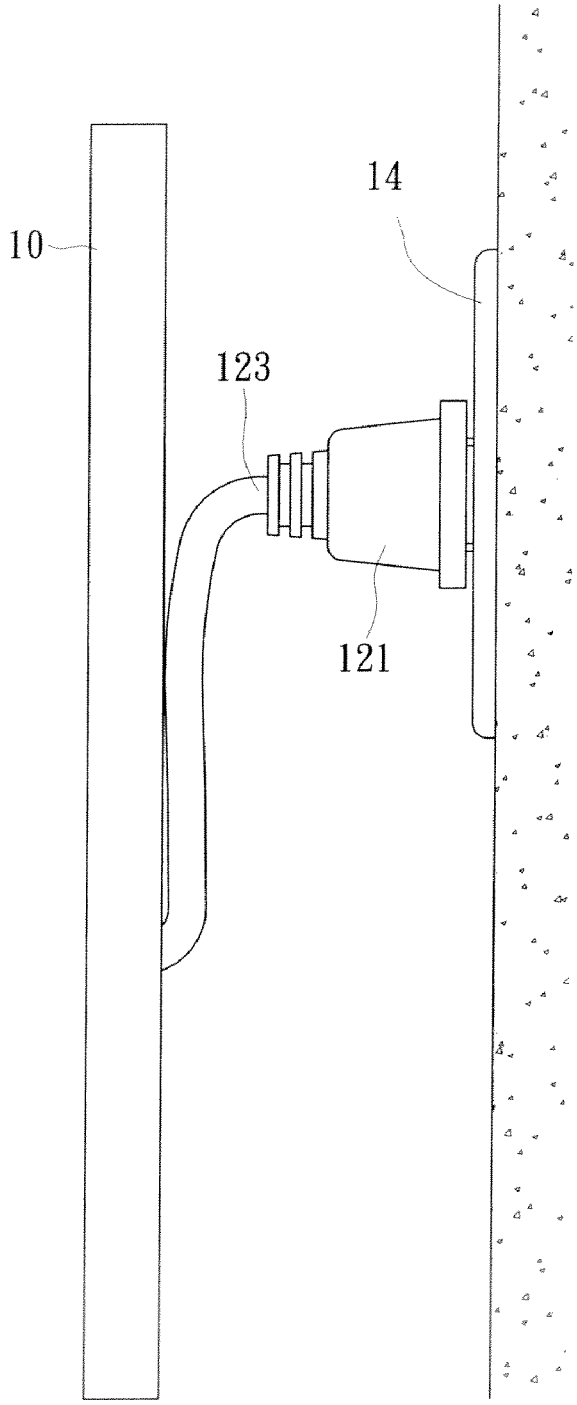
FIG. 1(PRIOR ART)
FIG. 1 illustrates a schematic diagram of an embodiment of the wall electrical power outlet according to the prior art.
Figure 2A:
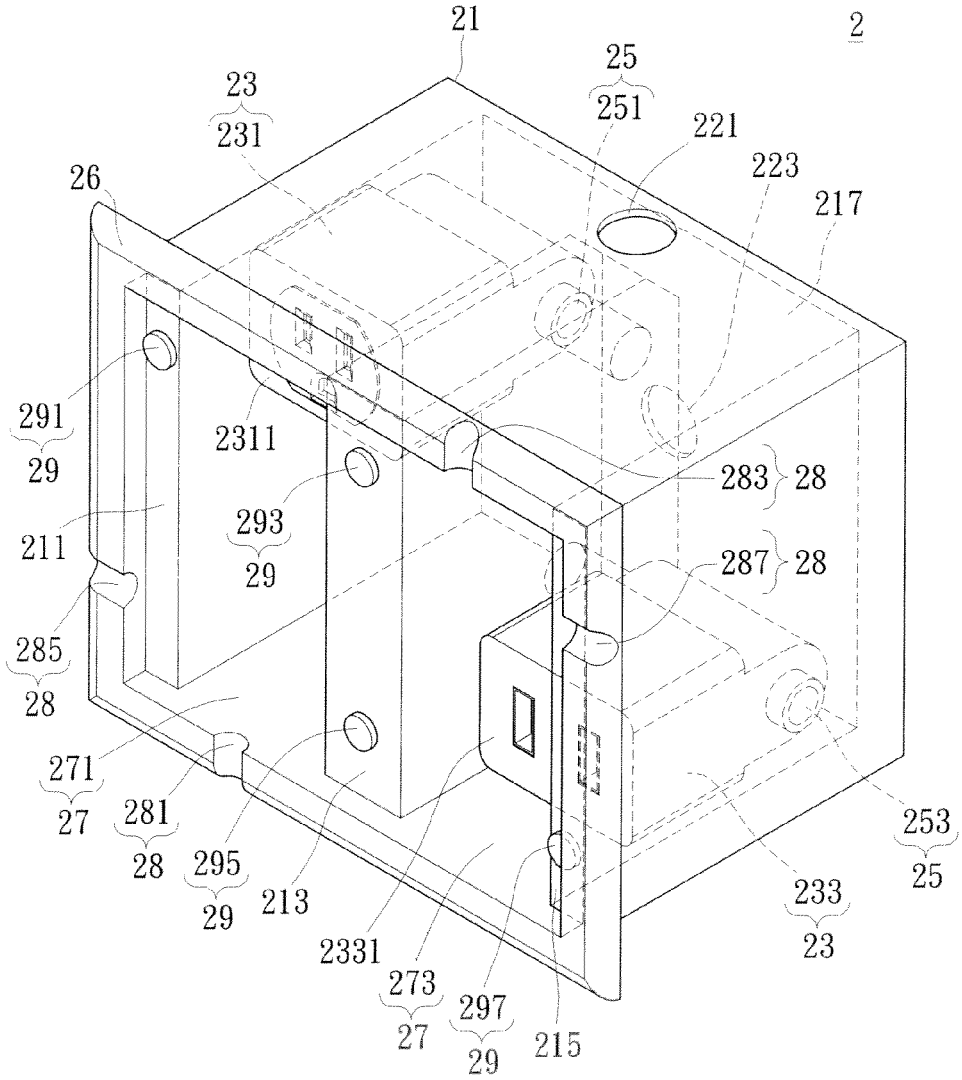
FIG. 2A illustrates a schematic diagram of an embodiment of in-wall mounted receptacle device in accordance with certain aspects of the present technique.

Please refer to FIG. 2A, in which a schematic diagram of an embodiment of the in-wall mounted receptacle device in accordance with certain aspects of the present technique is demonstrated. An in-wall mounted receptacle device 2 comprises a body 21, an electrical outlet box 23, a shaft unit 25, an accommodating section 27, a notch 28, and a locking unit 29.

The body 21 is formed by a plurality of side plates, wherein the plurality of side plates includes a first side plate 211, a second side plate 213, a third side plate 215, and a fourth side plate 217. The quantity of side plates 211, 213, 215, 217 is not restricted herein and the side plates are used to constructing the accommodating section 27. The accommodating section 27 may be of a cone shape, a cylindrical shape, a spherical shape, or a polyhedral shape. The aforementioned shape of the accommodating section 27 is illustrated merely for demonstration, but is not limited thereto. At least one electrical outlet box 23 provides one or more than one electrical plug (not shown) for operation, an electrical power plug, Coax, HDMI, DVI, RGB, or VGA signal line connectors, or a USB interface connector.

The electrical outlet box 23 may be disposed between the plurality of side plates 211, 213, 215, 217 by means of the shaft unit 25. It also means that the electrical outlet box 23 is rotatable within the accommodating section 27 formed by the plurality of side plates 211, 213, 215, 217 and the rotating angle of the electrical outlet box 23 is not limited herein, e.g., between 45 degrees to 90 degrees or any other degrees. Furthermore, the volume of the electrical outlet box 23 does not occupy the accommodating section 27 entirely, so that the electrical plugs (not shown) connected to the junction surface 231 are capable of receiving inside the accommodating section 27.

In the embodiment, the first side plate 211, the second side plate 231, and the fourth side plate 217 assemble into a first accommodating space 271, and the second side plate 213, the third side plate 215, and the fourth side plate 217 assemble into a second accommodating space 273. The electrical outlet box 23 includes a first electrical outlet box 231 and a second electrical outlet box 233. Herein, the first electrical outlet box 231 is an electrical power receptacle which is disposed inside the first accommodating space 271; the second electrical outlet box 233 is a HDMI jack which is configured inside the second accommodating space 273. The shaft unit 25 includes a first shaft portion 251 and a second shaft portion 253. Therein, the first shaft portion 251 is configured inside the first accommodating space 271 and disposed on the reverse side of a first junction surface 2311. The first shaft portion 251 couples to the first electrical outlet box 231, the first side plate 271, and the second side plate 273. The second shaft unit 253 is configured inside the second accommodating space 273 and disposed on the reverse side of a second junction surface 2331. The second shaft unit 253 coupled to the second electrical outlet box 233, the second side plate 273, and the third side plate 275.

Therefore through the abovementioned configuration of the shaft portions 251, 253 on the two ends of the electrical outlet boxes 231, 233 between the plurality of side plates 211, 213, 215, 217, the electrical outlet boxes 231, 233 may couple to the accommodating spaces 271, 273. Meanwhile, the shaft portions 251, 253 function by changing perpendicular directions of the junction surfaces 2311, 2331 of the electrical outlet boxes 231, 233. It also means that the perpendiculars direction of the junction surfaces 2311, 2331 may rotate outwardly or inwardly with respect to the accommodating spaces 271, 273, accordingly. The perpendicular directions may rotate into different orientations as shown in FIG. 2A to provide electronic devices (not shown) with different height levels for connection. The junction surfaces 2311, 2331 of the electrical outlet boxes 231, 233 are both in an exposed state as shown in FIG. 2A. While the electrical plugs of the different electronic devices connect to the junction surfaces 2311, 2331, the shaft portions 251, 253 may function to change the perpendicular directions of the junction surfaces 2311, 2331, so that the electrical outlet boxes 231, 233 are both in an concealed state, thereby concealing the electrical plugs inside the accommodating spaces 271, 273.

In the embodiment, the body 21 has an outer frame 26 which is disposed surrounding the accommodating spaces 271, 273. The outer frame 26 also has a notch 28. The number of the notch 28 is designed to correspond with the number of the electrical outlet boxes 231, 233 and align to the positions thereof. For example, it may have more than one notch 281, 283, 285, 287 and the size thereof is around the line width of the electric wire or a signal line. The locking unit 29 is disposed on the body 21 or coupled to the shaft unit 25 for locking or unlocking the rotating direction of the electrical outlet box 23 within the body 21. In actual practice, the locking unit 29 may include a knob, a button, or a switch and lock or unlock the electrical outlet box 23 in accordance with the operations by the user.

In the embodiment, the body 21 may further include more than one through hole 221, 223 which is configured on the plurality of side plates 211, 213, 215, 217, adjacent to the shaft portions 251, 253 for providing the electrical outlet boxes 231, 233 to electrically connect to the public electrical power distribution system (not shown).

Figure 2B:
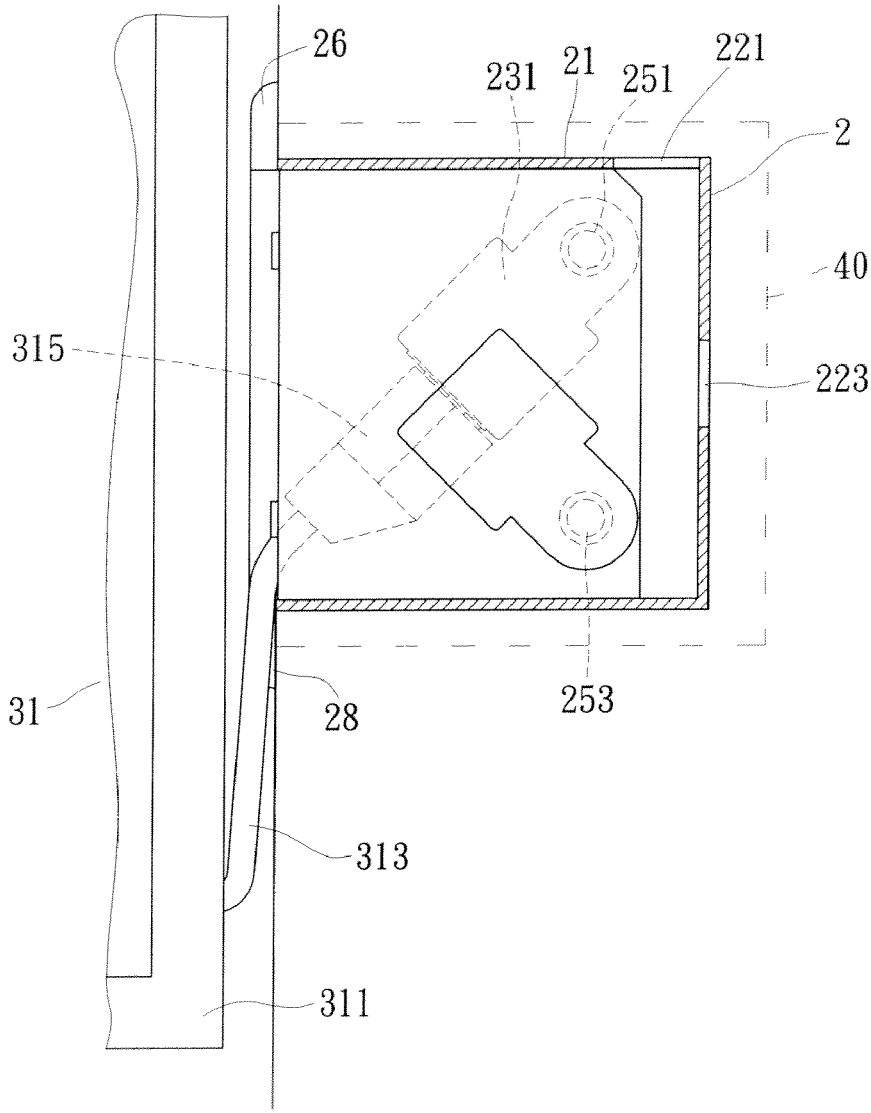
FIG. 2B illustrates a cross-section view of the embodiment of the in-wall mounted receptacle device in accordance with certain aspects of the present technique.

Please refer to FIG. 2B, in which a cross-section view of the embodiment of the in-wall mounted receptacle device in accordance with certain aspects of the present technique is demonstrated. An electronic device 31 includes a main body 31, an electrical plug 315, and an electric wire 313. The main body 311 may be a slim type displayer. The in-wall mounted receptacle device 2 is not tightly attached to a wall 40, but keeps a gap in between for allowing a power cable supplying the public electrical power passing thru a through hole 211, 223. The in-wall mounted receptacle device 2 connects to the wall 40 through the outer frame 26, so that the in-wall mounted receptacle device 2 may be embedded inside the wall 40 firmly.

When the user is trying to hang the electronic device 21 on the wall 40 or embed it inside the wall 40 to minimize the space occupied by the main body 311 of the electronic device 31 and maintains the overall environment is a tidy appearance, the in-wall mounted receptacle device 2 is usually disposed behind the electronic device 31. The in-wall mounted receptacle device 2 may be configured on the wall 40 or be embedded inside the wall 40.

When the user is intended to plug the electrical plug 315 into the electrical outlet box 231, it may adjust an operating surface (junction surface) of the electrical outlet box 231 to face toward the user for convenience in use. In other words, the perpendicular direction of the junction surface 2311 may rotate outwardly to be in an exposed state; then, the electrical plug 314 connects to the junction surface 2311 of the electrical outlet box 231. The perpendicular direction of the junction surface 2311 may be altered with respect to requirements of use. The perpendicular direction of the junction surface 2311 may rotate to be in a concealed state and the locking unit 29 may be utilized to attain the rotating direction of the electrical outlet box 23 inside the body 21, e.g., locking or unlocking. Hence, either one of the electrical plug 315 or the electric wire 313 connected to the electrical plug 315 or both of them may be accommodate inside the accommodating section 27. Consequently, the main body 311 of the electronic device 31 may be as close as possible to the wall 40 without pressing or pushing the electrical wire 313 adjacent to the electrical plug 315. The utilization space of the in-wall mounted receptacle device and the electrical plug 315 is reduced effectively.

Because the electric wire 313 may be externally exposed out of the in-wall mounted receptacle device 2 due to gravity relationship, a certain portion of the electrical sire 313 and the electrical plug 315 may be received inside the accommodating section 27, the others may be positioned thru the notch 28. The notch 28 may not merely attain the electric wire 313 but also reduce the possibility of bending or damaging the electrical wire 313.

Figure 3:
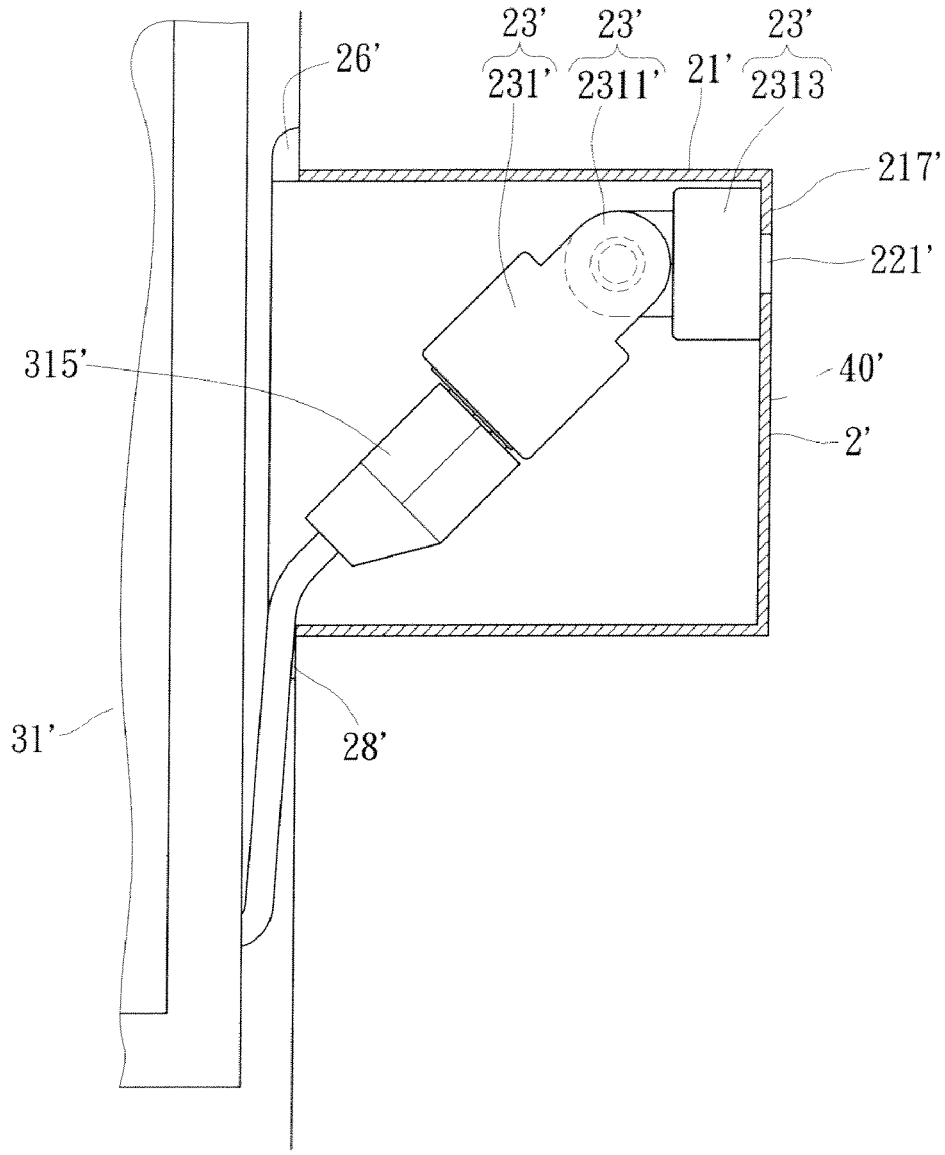
FIG. 3 illustrates a schematic diagram of another embodiment of the in-wall mounted receptacle device according to the present invention.

Please refer to FIG. 3, in which a schematic diagram of another embodiment of the in-wall mounted receptacle device according to the present invention is demonstrated. An in-wall mounted receptacle device 2' includes a body 21', an electrical outlet box 23', an outer frame 26', a notch 28', and through holes 221', 223'. The configurations of the present invention as shown in FIG. 3 and FIG. 2A are almost identical, however, the only difference is the electrical outlet box 23' includes a junction section 231', a hinge 2311', and a connection section 2313. Herein, the hinge 2311 couples to a fourth side plate 217' and is disposed adjacent to the through hole 221'. A power cable (not shown) of the public electrical power system may pass through the through hole 221' and then pass by the hinge 2311' to extend to the junction section 231', so that an input power is provided to tan electronic device 31' through the junction section 231'. Meanwhile, a distance (a gap) between the body 21' and a wall 40' is reduced and a utilization space for accommodating the electrical plug 314' of the electronic device 31' is improved effectively.

In the aspects of the aforementioned embodiments, the technical characteristics of the present invention are utilizing the electrical outlet box to be rotated inside the body in a certain angle from an exposed state to a concealed state, so that an electrical plug is capable of receiving inside an accommodating section of the body, the outer looking of the in-wall mounted receptacle device is in a tidy appearance, and the possibility for damaging the electric wire adjacent to the electrical plug by the electronic device is reduced. Consequently, the in-wall mounted receptacle device of the present invention may solve deficiencies and problems, i.e., low space utilization efficiency, associated with the conventional wall electrical power outlets.

The aforementioned descriptions represent merely the preferred embodiment of the present invention, without any intention to limit the scope of the present invention thereto. Various equivalent changes, alterations, or modifications based on the claims of present invention are all consequently viewed as being embraced by the scope of the present invention.

What is claimed is:

1. An in-wall mounted receptacle device, comprising:

a body, having an accommodating section and a through hole, wherein the through hole is disposed on the accommodation section; and an electrical outlet box, having a junction section and a connection section, wherein the junction section and the connection section are disposed inside the body, the connection section is aligned to the through hole, the body includes a hinge which is coupled to the connection section and the junction section for enabling a rotation of the junction section with respect to the hinge, and a power cable is passed through the through hole and the hinge to extend to the junction section;

wherein the junction section is adapted to rotate outwardly to a first predetermined position for a electrical plug having an electrical wire to be plugged into, and is adapted to rotate inwardly to a second predetermined position, and the electrical plug connected with the junction section and a first portion of the electrical wire adjacent to the electrical plug are capable of being received inside the accommodating section entirely when the junction section is at the second predetermined position.

2. The in-wall mounted receptacle device as claimed in claim 1, wherein the body includes an outer frame coupled to a surface of a wall.

3. The in-wall mounted receptacle device as claimed in claim 2, wherein the body further includes a notch disposed on the outer frame for positioning a second portion of the electrical wire that extends from the first portion of the electrical wire so as to allow for the second portion of the electrical wire to pass through the notch without being bent.

4. An in-wall mounted receptacle device, comprising:

a body having an accommodating section;

an electrical outlet box having a junction section and being disposed inside the body;

a shaft unit, being connected between the body and the electrical outlet box for enabling to a rotation of the electrical outlet box with respect to the shaft unit, wherein an orientation of the junction section varies and the junction section is adapted to rotate outwardly with respect to the shaft unit to a first predetermined position for an electrical plug having an electrical wire to be plugged into, and is adapted to rotate inwardly with respect to the shaft unit to a second predetermined position, and the electrical plug connected with the junction section and a first portion of the electrical wire adjacent to the electrical plug are capable of being received inside the accommodating section entirely when the junction section is at the second predetermined position; and a locking unit, being coupled to the electrical outlet box, wherein the locking unit is configured to lock and unlock alternatively the junction section.

5. The in-wall mounted receptacle device as claimed in claim 4, wherein the body includes an outer frame coupled to a surface of a wall.

6. The in-wall mounted receptacle device as claimed in claim 5, wherein the body further includes a notch, being disposed on the outer frame for positioning a second portion of the electrical wire extends from the first portion of the electrical wire so as to allow for the second portion of the electrical wire to pass through the notch without being bent.

* * * * *